United States Patent [19]

Inaba

[11] Patent Number: 4,498,987

[45] Date of Patent: Feb. 12, 1985

[54] MAGNETIC SEPARATOR

[75] Inventor: Morimitsu Inaba, Kamakura, Japan

[73] Assignees: Inabac Corporation; AMT Co., Ltd., both of Tokyo, Japan

[21] Appl. No.: 447,758

[22] Filed: Dec. 8, 1982

[30] Foreign Application Priority Data

Dec. 16, 1981 [JP] Japan ..... 56-186400[U]

[51] Int. Cl.[3] ..... B03C 1/10

[52] U.S. Cl. ..... 210/222; 209/224; 209/231; 210/223; 210/261; 210/262; 210/512.1

[58] Field of Search ..... 210/222, 223, 695, 415, 210/523, 528, 360.1, 262, 361, 360.1, 377, 378, 210/366, 380.1, 512.1, 220.1; 209/223.1, 232, 224, 209/225, 35; 198/661, 668; 494/22, 23

[56] References Cited

U.S. PATENT DOCUMENTS

| | | | |
|---|---|---|---|
| 2,491,912 | 12/1949 | Walker | 210/523 |
| 3,402,820 | 9/1968 | Lohmann | 210/222 |
| 3,437,209 | 4/1969 | Evans | 210/380.1 |
| 3,585,924 | 6/1971 | Nolan | 210/415 |
| 4,162,978 | 7/1979 | Lidman et al. | 210/415 |
| 4,234,074 | 11/1980 | Martin | 210/222 |

FOREIGN PATENT DOCUMENTS

| | | | |
|---|---|---|---|
| 48173 | 4/1977 | Japan | 209/223.1 |
| 131169 | 10/1979 | Japan | 210/223 |
| 855929 | 12/1960 | United Kingdom | 210/222 |

*Primary Examiner*—Richard V. Fisher
*Assistant Examiner*—W. Gary Jones

[57] ABSTRACT

A magnetic separator useful for treating chips in a machine tool is disclosed, which comprises a separating cylinder, a plurality of magnetic plates arranged at an outer periphery of the cylinder and spaced apart each other, an inlet for a fluid suspension at a middle part of the cylinder, outlets for a separated fluid at one end and for the suspended matter, such as machined chips, at the other end of the cylinder, and a screw conveyor inserted into the cylinder in such a way that the screw conveyor is contacted at its peripheral edge with an inner wall of the cylinder. The magnetic plates are arranged in a circle around the cylinder with the polarity of the adjacent magnetic plates arranged in a special sequence for generating a maximum magnetic flux toward the axial center of the cylinder. Also, the magnetic plates extend from the inlet near the middle of the cylinder to both outlets at opposite ends of the cylinder for achieving a strong magnetization of the chips suspended in the fluid.

11 Claims, 9 Drawing Figures

MAGNETIC SEPARATOR

FIELD OF THE INVENTION

This invention relates to an apparatus for treating chips, such as machined chips and ground chips, produced by various machine tools, and more particularly to a magnetic separator for efficiently removing solid suspended matter from a suspension thereof in a machining or grinding fluid, utilizing a magnetic force.

BACKGROUND OF THE INVENTION

Heretofore, various apparatus for removing relatively large machined chips have been proposed and utilized for treating these chips as produced by machine tools. However, these apparatus cannot remove fine chips, which in turn are collected together with a machining fluid in a coolant tank and precipitated therein. Thus, if a large amount of the fine chips precipitates in the coolant tank, a capacity of the tank is insufficient for the machining fluid, which overflows from the tank. As a result, a fire accident may occur due to oil property of the fluid. Further, circulation of the unremoved chips together with the fluid may block an ejecting nozzle for the fluid thereby to cause damage of the tools and worse quality of machined works. Furthermore, a setting disorder may arise in a machining center upon replacement of automatic tools, thereby to adversely affect a machining accuracy.

In view of the foregoing, an apparatus of such a type has been proposed that a conventional coolant tank is provided at its inner bottom with a screw conveyor for removing the precipitated chips therefrom. In such type of apparatus, however, the conveyor was generally arranged horizontally in consideration of its conveying capacity and was impossible to be arranged obliquely for the purpose of reducing a setting area.

Since most of the machined chips are generally magnetic in nature, an apparatus provided at its bottom with a magnetic plate has also been proposed to aggregate the magnetic chips at the bottom within the tank, from which they are scraped and removed by a scraper. Such apparatus, however, necessitates also enlargement of a setting area for the magnetic plate in order to increase the aggregation, thereby to require a large size of the scraper. Thus, the apparatus becomes necessarily large, thereby to raise an equipment cost.

Accordingly, it has long been needed to provide an apparatus for treating chips, which is compact and achieves efficient recovery and removal of the chips, as well as reduction of the equipment cost.

It has now been found out that an apparatus comprising a separating cylinder of a non-magnetic material, such as stainless steel, which is provided at its outer periphery with a plurality of magnetic plates spaced apart each other and contains therein a screw conveyor constructed of a non-magnetic material, allows the chips suspended in a machining fluid to be magnetised by a magnetic-inducing effect generated within the cylinder thereby to be attracted and deposited onto an inner surface of the cylinder and then to be scraped efficiently by the screw conveyor which transports the scraped chips to the outside.

Thus constructed apparatus or the magnetic separator is possible to attract any magnetic materials in the suspension onto the whole inner wall of the cylinder and to surely scrape and transport the attracted chips to the outside. As a result, the cylinder or the separator may be inclined at an angle up to 90° relative to the horizontal plane, thereby to achieve considerable reduction of the volume and the setting area of the separator.

Accordingly, a general object of the invention is to provide a magnetic separator which is compact but achieves an efficient removal of chips from a suspention, reduction of a setting area and hence an equipment cost, as well as convenient control and maintenance.

SUMMARY OF THE INVENTION

A principal object of the invention is to provide a magnetic separator which comprises a separating cylinder, a plurality of magnetic plates of a predetermined size arranged at an outer periphery of the cylinder and spaced apart from each other, an inlet for a fluid suspension arranged at a middle part of the cylinder, an outlet for the suspended matters arranged at one end of the cylinder and an outlet for a separated fluid at the other end, and a screw conveyor constructed of a non-magnetic material and inserted into the cylinder, said screw conveyor being contacted at its peripheral edge with an inner wall of the cylinder.

Other objects and advantages will be more apparent from the description hereinafter.

PREFERRED EMBODIMENTS OF THE INVENTION

The invention will be described in more detail hereinbelow for the preferred embodiments with reference to the accompanying drawings.

Figure 1:
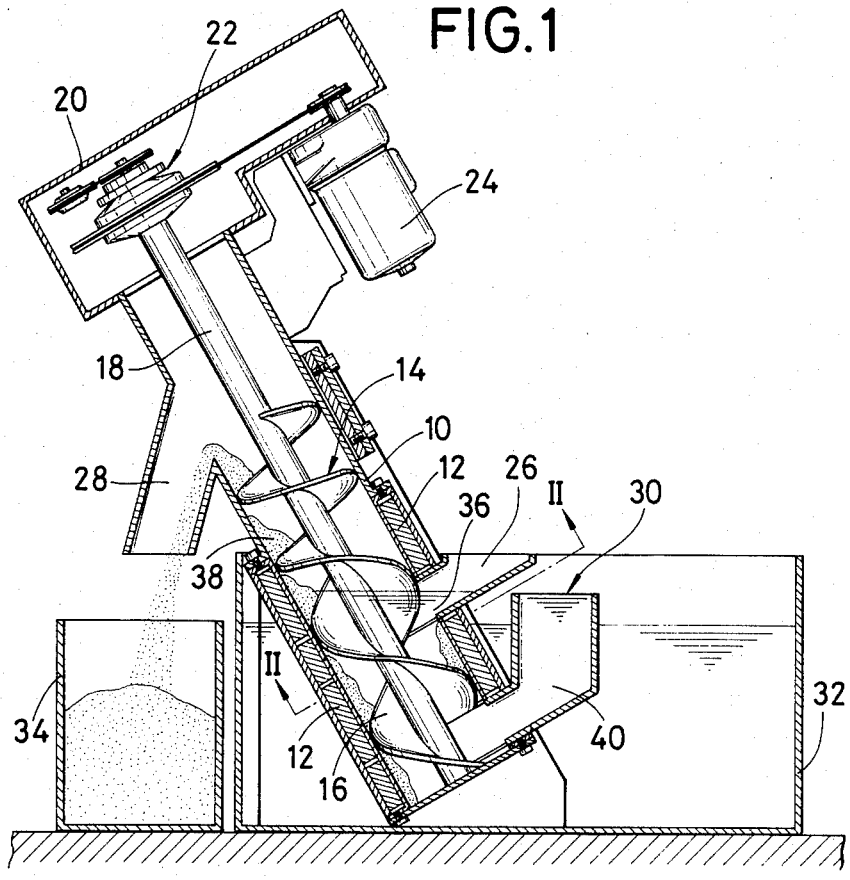
FIG. 1 is a partially sectioned side view of one embodiment of a magnetic separator according to the invention.
Figure 2:
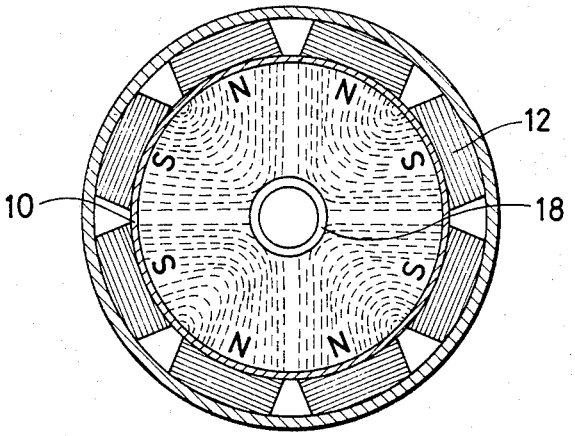
FIG. 2 is a sectional view of the magnetic separator through line II—II in FIG. 1.

FIGS. 1 and 2 illustrate one embodiment of a magnetic separator according to the invention. The separator comprises a separating cylinder 10 which is constructed of a non-magnetic material, such as stainless steel, and is inclined at a predetermined angle relative to the horizontal plane. The cylinder 10 at its outer periphery is provided with a plurality of magnetic plates 12 of a predetermined size spaced apart each other and contains therein a screw conveyor 14 also constructed of a non-magnetic material. The screw conveyor 14 is provided with a screw 16, which extends longitudinally along arrangement of the magnetic plates 12 and is substantially contacted with an inner wall of the cylinder 10. A shaft 18 of the screw conveyor 14 is extended from a bottom to a top of the cylinder 10 and is inserted into a casing 20 for a driving apparatus arranged at the top. In the casing 20 is arranged a rotation transmitting mechanism 22, to which are connected the shaft 18 and a driving motor 24 through a belt.

The separating cylinder 10 is further provided at its middle part of the distributed magnetic plates 12 with an inlet 26 for a fluid suspension and at a location corresponding to an upper end of the screw conveyor 14 with an outlet 28 for suspended matter, such as machined chips. Further, the cylinder 10 is provided at its bottom with an outlet 30 for a separated fluid.

The bottom of the cylinder 10 is dipped in and secured to a tank 32 for the separated fluid. The outlet 30 at its open upper end is positioned above a fluid level of the tank 32, while the outlet 28 at its open end is located directly above a reservoir 34 adjacent to the tank 32, as best shown in FIG. 1.

Operation of thus constructed magnetic separator will be described hereinbelow.

At first, a suspension 36 containing suspended matter, such as chips, is introduced through the inlet 26 into the cylinder 10 and is filled up to a level corresponding to the upper open end of the outlet 30 for the separated fluid. When the suspension 36 is filled within the cylinder 10, a plurality of the magnetic plates 12 arranged at the outer periphery of the cylinder 10 attracts the magnetic suspended matter 38, such as chips, onto the inner wall of the cylinder 10. The separated magnetic matters 38 on the wall are then scraped and transported upward by the screw conveyor 14, and then discharged through the outlet 28 into the reservoir 34. On the other hand, the separated fluid 40 freed from the suspended matter 38 is continuously overflowed from the upper open end of the outlet 30 into the tank 32.

In accordance with the embodiment described hereinabove, the suspended matter 38 may be separated and removed from the suspension while the useful separated fluid, such as a machining or grinding oil, may be recovered.

In accordance with the invention, the magnetic-inducing effect will be described with reference to FIGS. 1 and 2. When a plurality of the magnetic plates 12 is arranged at the outer periphery of the cylinder 10, two adjacent magnetic plates 12 are provided with opposite polarities to each other in order to generate stronger magnetic force relative to a center of the cylinder 10 (FIG. 2). That is, the magnetic plates 12 are arranged in a circle around the cylinder 10 with each given plate having an adjacent magnetic plate of opposite polarity located to one side of such given plate while an adjacent magnetic plate of the same polarity is located at the other side of such given magnetic plate so that such plates are arranged in a north-north-south-south-north-north-south-south sequence as shown in FIG. 2. This special arrangement of the polarities of the magnetic plates produces a magnetic flux which is significantly elevated toward the central shaft 18 for achieving strong magnification of the chips contained in the suspension 36. As a result, the suspended matter 38, such as chips, in the cylinder 10 may be readily magnetized and attracted each other entrapping other non-magnetic substances to the inner wall of the cylinder 10. Each magnetic plate is preferably consisted of a permanent magnet, such as ferritic or rare earth magnets and is of any shape such as triangle, rectangle or the like. A size of the magnetic plate 12 is preferably in the range of 10–40 $cm^2$ in area and 1–3 cm in thickness. Preferably, 30–50 plates are arranged around the cylinder 10 and spaced apart each other in a distance of 1–5 cm in the mosaic or staggered configuration with optionally opposite polarities.

A cyclone effect is produced by the magnetic separator in accordance with the invention, wherein the fluid suspension 36 filled up to the predetermined level in the cylinder 10 is subjected to a centrifugal force of the screw conveyor 14 to impinge the suspended matter 38 against the inner wall of the cylinder 10 thereby to enhance the magnetic-inducing effect for efficient removal thereof. The rotation rate of the screw conveyor 14 varies upon a flow rate of the fluid suspension, a concentration of the suspended matter, a pitch of the screw and others and is generally in the range of 8–70 rpm.

The magnetic suspended matter 38 subjected to the magnetic-inducing and the cyclone effects described hereinbefore is then subjected to an interpole magnetic force proportional to the product of magnetism quantities, to thereby aggregate the suspended matter with each other and to increase the mass weight and thus to considerably enhance the depositing ability of the aggregated matter on the surface of the cylinder 10. Particularly, upon aggregation the suspended matter 38 entraps the non-magnetic substances therein to efficiently improve the separation and recovery.

A portion of the non-magnetic substances is entrapped in the aggregated matter due to the aggregation effect and deposited on the inner wall of the cylinder 10, while the remaining portion of non-magnetic substances of relatively larger size is precipitated on the bottom of the cylinder 10 and then transported by the screw conveyor 14 together with the separated magnetic matter toward the outlet 28. On the other hand, the separated fluid 40 is discharged from the upright outlet 30, so that a flow rate of the fluid 40 in the outlet 30 is decreased to a half of the flow rate in the cylinder 10. Thus, any non-magnetic substances remained in the fluid 40 is again precipitated on the bottom due to the gravity, to thereby improve the separation efficiency.

The floating sludge and foreign scum produced in the cylinder may be urged upward by the magnetic-inducing-, cyclone- and aggregation effects toward the outlet 28, to thereby improve the separation efficiency.

In accordance with the invention, the screw conveyor 14 is provided with a screw 16 of a higher pitch at the outlet 28 side, for example about 3 times, than at the bottom side, so that a transportation rate at the outlet 28 side is reduced to $\frac{1}{3}$. The reduction of the transportation rate together with the weaker magnetic-inducing effect on the upper side thus increases the compaction of the suspended matter, to thereby provide an efficient liquid removal effect.

Figure 3:
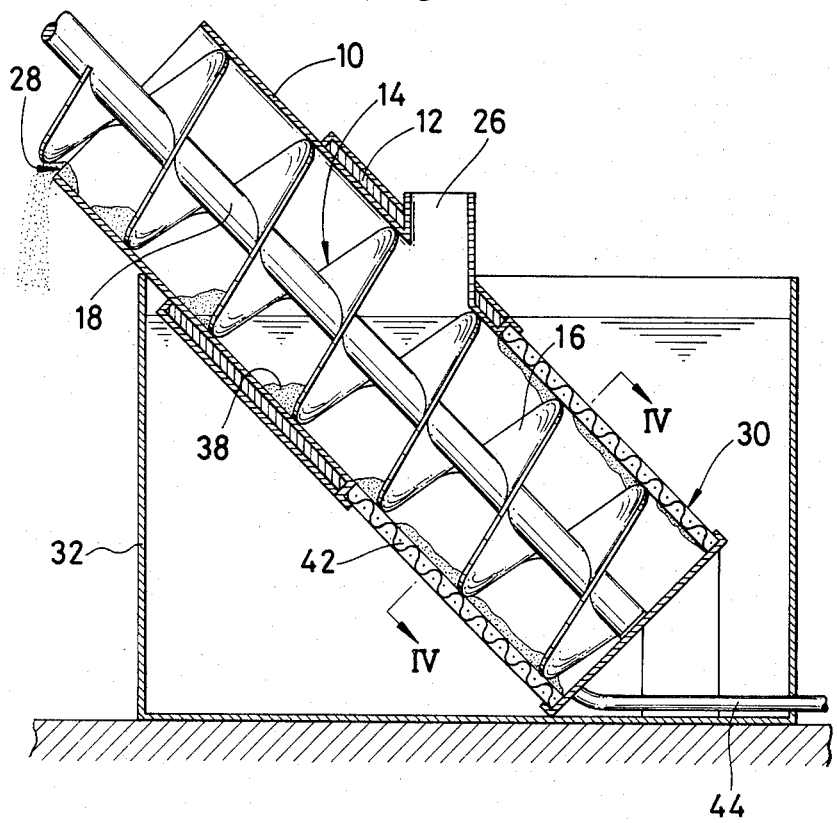
FIG. 3 is a partially sectioned side view of another embodiment of the magnetic separator according to the invention.
Figure 4:
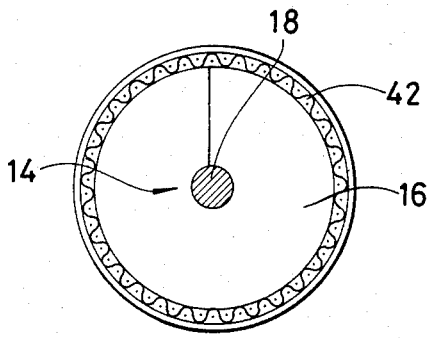
FIG. 4 is a sectional view of the magnetic separator through line IV—IV in FIG. 3.

FIGS. 3 and 4 illustrate another embodiment of the separator according to the invention. The cylinder 10 at its lower part is replaced with a liquid-permeable cylinder 42 constructed of a wedge wire, a screen, a porous material or the like. A mesh size of the liquid-permeable cylinder 42 may vary depending on the concentration and particle size of the suspended matter and is generally in the range of 0.3–1.3 mm, preferably 0.7–0.9 mm.

Thus constructed magnetic separator according to this embodiment allows the rapid and smooth separation of the non-magnetic suspended matter on the liquid-permeable cylinder 42, thereby to improve the separation efficiency. In order to facilitate removal of the deposited matters on the inner wall of the permeable cylinder 42, the screw 16 at its corresponding portion is preferably provided with a scraper, such as a brush. If the suspension contains fine suspended matter, the cylinder 42 at its bottom may be provided with an air-blowing tube 44 for blowing a sufficient quantity of air into the suspension to float up the fine matter with bubbles, thereby to guide them together with the magnetic matter toward the outlet 28. While the tank 32 receiving the cylinder 10 is generally open to carry-out the gravitational separation, the tank 32 may be of a closed type for maintaining a negative pressure therein and carrying out separation through suction.

Figure 5:
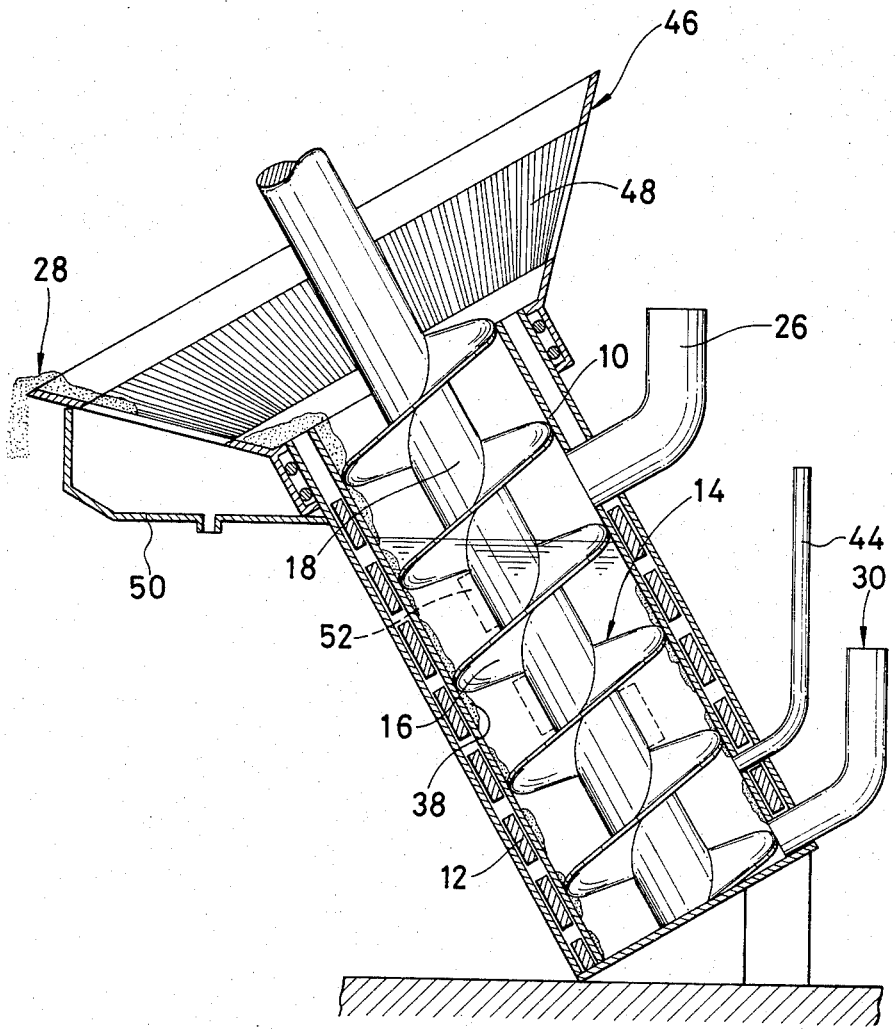
FIG. 5 is a partially sectioned side view of still another embodiment of the magnetic separator according to the invention.

FIG. 5 shows a further embodiment of the separator according to the invention. The cylinder 10 at its outlet 28 position is provided rotatably with an inverted conical centrifuge 46, at an inner circumference of which are provided slits 48 for passing the fluid therethrough. Under the slits 48 is arranged a vessel 50 for collecting the separated fluid. The slit 48 may be formed of a wedge wire, a screen or a porous material. A rotation rate of the centrifuge 46 is generally in the range of 500 to 2500 rpm, preferably 750–2000 rpm. Thus constructed separator improves the fluid-removal efficiency from the suspended matter which in turn are discharged from the outlet 28. Further, the screw shaft 18 may be provided radially with projections 52 of magnetic materials for improving the magnetic-inducing effect within the cylinder 10.

Figure 6:
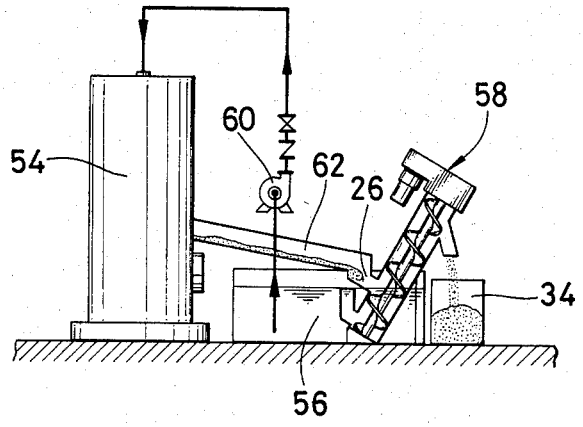
FIG. 6 is a pictorial view showing an embodiment of a machine tool attached with the magnetic separator as a chip-treating apparatus according to the invention.
Figure 7:
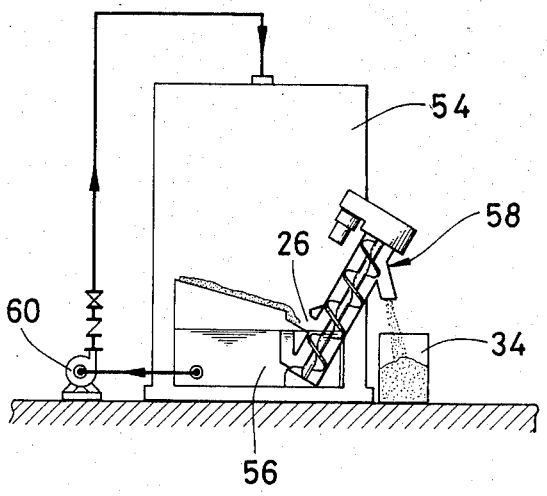
FIG. 7 is a pictorial view showing an embodiment of a machine tool containing therein the magnetic separator as the chip-treating apparatus according to the invention.

FIGS. 6 and 7 illustrate an embodiment of a machine tool provided with the magnetic separator as a chip-treating apparatus according to the invention. In FIG. 6, the magnetic separator 58 of the invention is received in a coolant tank 56 located outside the machine tool 54. A coolant in the tank 56 is fed through a pump 60 to the machine tool 54 and is then introduced via a duct 62 into the magnetic separator 58 through its inlet. In FIG. 7, on the other hand, the magnetic separator 58 according to the invention is received in the coolant tank 56 which is accommodated in the machine tool 54. The coolant in the tank 56 is circulated through the pump 60 to the machine tool 54 and the resulting contaminated coolant in the machine tool 54 is introduced into the magnetic separator through its inlet 26.

Figure 8:
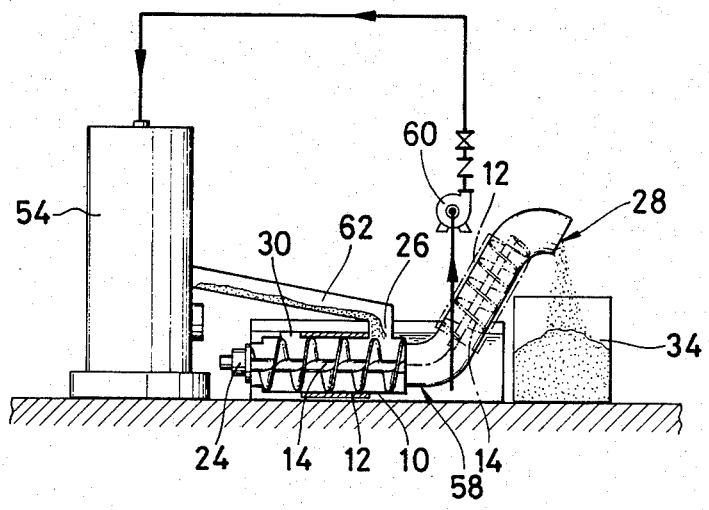
FIG. 8 is a pictorial view showing an embodiment of a machine tool attached with a modified magnetic separator according to the invention.
Figure 9:
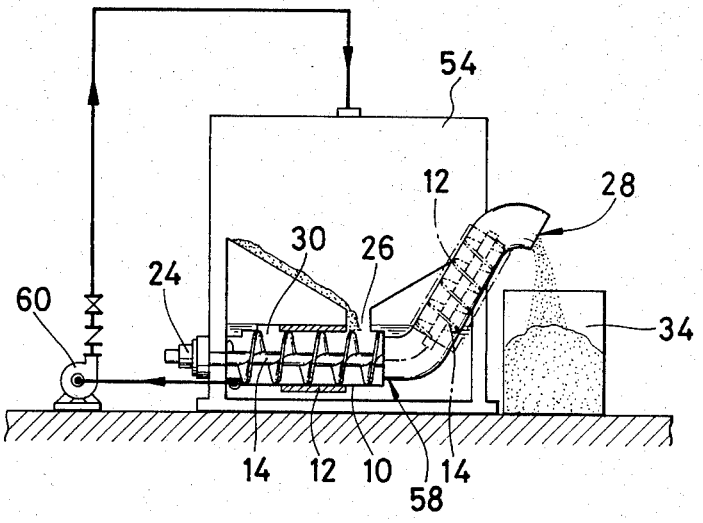
FIG. 9 is a pictorial view showing an embodiment of a machine tool containing therein the modified magnetic separator according to the invention.

FIGS. 8 and 9 illustrate another embodiment of the machine tool provided with the magnetic separator 58 as the chip-treating apparatus according to the invention. Within the coolant tank 56 is horizontally arranged the cylinder 10, one end of which is secured to one side of the tank 56. Into the cylinder 10 is inserted the screw conveyor 14, the shaft 18 of which is connected to the motor 24 arranged outside the tank 56. Further, the cylinder 10 at its other end is lifted at a predetermined angle and placed outside the coolant tank 56 to position the open end 28 of the cylinder 10 directly above the reservoir 34 adjacent to the coolant tank 56. In this case, the lifted section of the cylinder 10 may be also provided therein with the screw conveyor 14 and at its outer periphery with the magnetic plates 12. Thus constructed magnetic separator 58 also ensures that the fluid suspension supplied through the inlet 26 is efficiently separated into the suspended matter and the fluid by the various effects in the cylinder 10 and that the suspended matter are discharged through the outlet 28 into the reservoir 34 while the separated fluid is smoothly recycled through the outlet 30 into the coolant tank 56. In this embodiment, FIG. 8 shows the magnetic separator located outside the machine tool while FIG. 9 shows the magnetic separator contained within the machine tool.

Although the invention has been described hereinabove with the preferred embodiments, it will be appreciated that the magnetic separator according to the invention may be widely applied to various machine tools, such as a cutter, a grinder, a rolling mill, a scrubber, a honing machine and others, for separating inorganic suspended matter (such as iron chips) from a machining oil or an engine oil and that many variations and modifications may be made without departing from the true spirit and scope of the invention.

What is claimed is:

1. A magnetic separator for at least separating magnetizable solid matter suspended in a fluid, which comprises a separating cylinder having a top end and a bottom end, a plurality of magnetic plates of a predetermined size arranged at an outer periphery of the cylinder and spaced apart from each other, said magnetic plates being arranged in a circle around said cylinder with each magnetic plate having an adjacent magnetic plate of opposite polarity located to one side of it and an adjacent magnetic plate of the same polarity located at its other side such that said magnetic plates are arranged in a north-north-south-south-north-north-south-south- . . . sequence to thereby generate a maximum magnetic flux to substantially the axial center of said cylinder means defining an inlet for a fluid suspension arranged at a middle part of the cylinder, means defining an outlet for a separated fluid arranged at the bottom end of the cylinder and means defining an outlet for the separated suspended matter arranged at the top end of the cylinder, and a screw conveyor of a non-magnetic material within the cylinder and having a peripheral edge in engagement with an inner wall of the cylinder, said magnetic plates extending around said cylinder substantially along the entire longitudinal length of said cylinder from said bottom end near said fluid outlet to said fluid suspension inlet, and also from said inlet to said top end near said outlet for said separated suspended matter, whereby a strong magnetization of suspended matter is achieved.

2. A magnetic separator as claimed in claim 1, wherein each magnetic plate comprises a permanent magnet selected from ferritic magnets and rare earth magnets.

3. A magnetic separator as claimed in claim 1, wherein the cylinder is inclined at an angle up to 90° relative to the horizontal plane.

4. A magnetic separator as claimed in claim 1, wherein the screw conveyor is provided with a screw of lower pitch in the vicinity of the outlet for the suspended matter than in the fluid outlet side.

5. A magnetic separator as claimed in claim 1, wherein bubble forming means is provided for floating non-magnetic fine matter in the fluid suspension toward said outlet for the separated suspended matter for discharge therewith.

6. A magnetic separator as claimed in claim 1, wherein the cylinder is provided at its outlet for the separated suspended matter with a conical centrifuge mounted at said top end of said cylinder in an inverted manner with the smaller conical end aligned with said outlet for separated suspended matter for rotatably removing fluid.

7. A magnetic separator as claimed in claim 1, wherein the cylinder is provided at its outlet side for the separated fluid with a filtration liquid-permeable cylinder into which the screw conveyor extends.

8. A magnetic separator as claimed in claim 1, wherein the separating cylinder comprises a horizontal section and a rising section adjacent thereto at a predetermined angle for discharging the suspended matter.

9. A magnetic separator as claimed in claim 8, wherein the rising section is provided at its outer periphery with magnetic plates and contains a screw conveyor therein.

10. An apparatus for treating chips, comprising a magnetic separator as claimed in claim 1 in which the magnetic separator is received in a coolant tank arranged outside or inside of a machine tool.

11. A magnetic separator as claimed in claim 1, wherein the plurality of magnetic plates are arranged about and in contact with the periphery of the outer surface of the cylinder and being spaced apart from each other in circumferential direction a distance less than the circumferential extent of each of the magnetic plates, said inlet for the fluid suspension communicating with the interior of the screw conveyor through a space provided therefor within the circle of magnetic plates.

* * * * *